United States Patent [19]

Kandel

[11] 4,004,296

[45] Jan. 25, 1977

[54] MULTIPLE STRIP GARMENT WITH STITCHED TAPE BORDER AND METHOD OF MANUFACTURING SAME

[76] Inventor: Walter Kandel, 4834 N. Interstate Ave., Portland, Oreg. 97201

[22] Filed: June 23, 1975

[21] Appl. No.: 589,042

[52] U.S. Cl. ..... 2/211; 2/243 R

[51] Int. Cl.[2] ..... A41D 1/14

[58] Field of Search ..... 2/220, 221, 211, 236, 2/237, 76, 243; D2/223, 224

[56] References Cited

UNITED STATES PATENTS

| | | | |
|---|---|---|---|
| 2,121,836 | 6/1938 | Steinberger | 2/236 |
| 2,438,804 | 3/1948 | Hardie | 2/221 |
| 2,546,563 | 3/1951 | Rodin et al. | 2/211 |
| 2,708,274 | 5/1955 | Vander et al. | 2/237 |
| 3,122,755 | 3/1964 | Rosen et al. | 2/221 |

FOREIGN PATENTS OR APPLICATIONS

| | | | |
|---|---|---|---|
| 1,368,798 | 6/1964 | France | 2/220 |

*Primary Examiner*—H. Hampton Hunter
*Attorney, Agent, or Firm*—Eugene D. Farley

[57] ABSTRACT

A garment having a folded backing strip adhesively carrying a depending fringe secured therein by stitch fastening means. One species employs a plurality of individual ribbons for the fringe, while another species utilizes a fringe formed from a cut sheet, having an upper margin and attached ribbons.

12 Claims, 8 Drawing Figures

MULTIPLE STRIP GARMENT WITH STITCHED TAPE BORDER AND METHOD OF MANUFACTURING SAME

BACKGROUND OF THE INVENTION

This invention relates in general to garments, and especially to cheer leader's skirts. However, it also may be adapted for use in connection with various other items of wearing apparel.

It is the common practice for rally girls or cheer leaders to wear matching items of clothing coordinated to the colors of their school. Quite often they utilize a short, multi-panelled skirt for this purpose. Such skirts are generally manufactured from wool or one of the newer synthetic materials, and are relatively expensive. Often the skirts are used for only a short time period, such as a single sport season, or at most for a single year, particularly in the case of high school students, the costs of such skirts is burdensome for many of the individuals who are candidates for a cheer leader position.

In addition, many times it is desirable to obtain color or aesthetic effects which are difficult to obtain with the present skirts of this class. Generally, the materials used are produced only in certain standard colors. In addition, the designs heretofore utilized do not readily lend themselves to the use of a great many different pieces of the particular material at any one time, as would be necessary for multiple or overlaying colors.

Furthermore, the present skirts of this class are generally fabricated from fabric material which is at least somewhat water absorbent. When used during the outdoor sport season, particularly in Northern climates, this can be quite annoying.

Lastly, due to the divergence of social mores in different geographical areas it is desirable to make skirts of this type in a wide range of lengths and effective coverage. Again, the present garment designs do not lend themselves readily to this diversity.

Accordingly, the general object of the present invention is to provide a garment, particularly a skirt for use by cheer leaders, which is relatively inexpensive to manufacture, and which is correlated in material, color and design with the stranded pom-pons conventionally carried by cheer leaders and used in their cheer-leading activities.

It is a further object of the invention to provide such a garment that can utilize a wide variety of inexpensive materials.

It is a further object of the invention to provide such a garment that can be easily adapted for a wide variety of lengths and densities.

It is a further object of the invention to provide such a garment that is adaptable to multicolor overlay designs.

It is a further object of the present invention to provide a method of manufacturing a garment, particularly an inexpensive skirt for use by cheer leaders.

It is a further object of the present invention to provide a method of manufacture for such garments that does not require special machinery or skilled personnel.

It is a further object of the present invention to provide a method of manufacturing such garments in a wide variety of lengths and densities.

It is a further object of the present invention to provide a method of manufacturing such garments that is adaptable to multicolor overlay designs.

THE DRAWINGS

The manner in which the foregoing and other objects of the invention are accomplished will be apparent from the accompanying specification and claims considered together with the drawings, wherein:

GENERAL STATEMENT OF THE INVENTION

Figure 1:
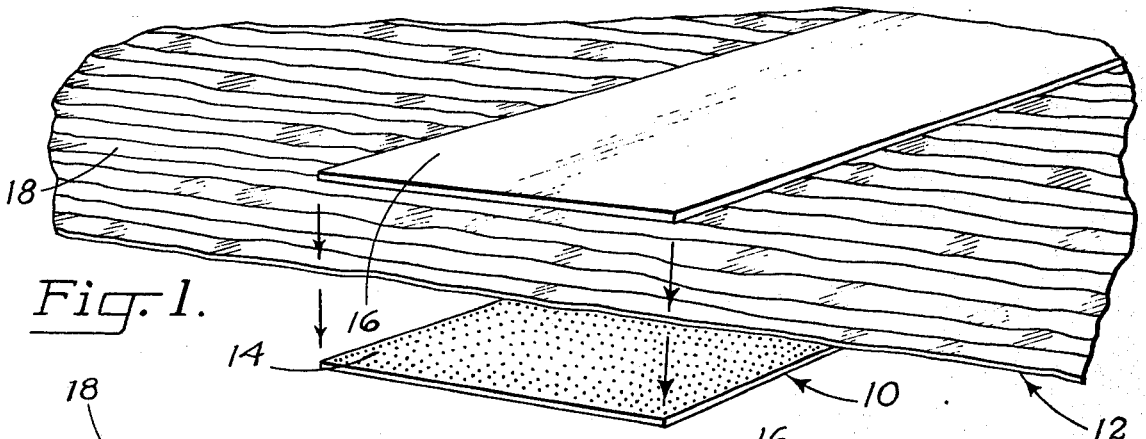
FIG. 1 is a fragmentary, exploded, pictorial view showing the relationship of the various elements of my invention.

My invention provides a garment, generally comprising a backing strip having depending therefrom a fringe. The backing strip forms a waist band and adhesively carries the fringe in a transverse orientation, the latter thus forming a fringe type skirt. The backing strip is reversely folded and stitch fastening means through the backing strip and fringe permanently maintain the assembly.

The backing strip is normally fabricated from a piece of pressure sensitive material, such as tape, although other adhesive means can be utilized. In one species, two such backing strips are used, one on top of the other, with the fringe sandwiched in between.

In this species the fringe comprises a plurality of thin, elongate strips of plastic which preferably are centered substantially transversely on the backing strips. The backing strips are then folded along their longitudinal axes overlaying a portion of the fringe on top of the remaining portion. The folded assembly is then secured by stitch fastening means along the extent of the backing strips.

Another species utilizes only one such backing strip. The fringe comprises cut sheets of thin plastic with depending ribbons and a continuous upper margin. The margin is placed longitudinally on only part of the backing strip, and the remaining portion of the backing strip then is folded over on top of the fringe margin. The assembly again is secured by stitch fastening means.

In either species the density of the fringe may be increased by using multiple layers of fringe. Also, if multiple layers are used, each can be of a different color or length to achieve various aesthetic effects.

Releasable fastening means are attached to each end of the backing strip in order to join the garment when in use.

My invention also provides a method of manufacturing garments, which generally comprises placing a fringe transversely across a backing strip. The fringe is adhesively secured to the backing strip which then is reversely folded about the fringe. Stitch fastening means is placed in the backing strip and fringe to permanently maintain the assembly.

In one species, the first step of the method is to place a first backing strip in a flat orientation. Normally, the backing is fabricated from a piece of pressure sensitive tape. If not, however, a bead of adhesive is placed on top of the strip.

A fringe comprising a plurality of thin, elongate strips of plastic is placed on the backing strip, preferably substantially centered and transversely of the backing strip.

A second backing strip is placed, adhesive downward, on top of the first, sandwiching the fringe in between. The backing strips are folded along their longitudinal axes overlying a portion of the fringe on top of the remainder. Stitch fastening means is then placed in the fringe and backing strips to secure the backing strips in their folded position.

In another species, the method of manufacture utilizes only one such backing strip. A fringe comprising cut sheets with depending ribbons and a continuous top margin is provided. The margin is placed on part of the backing strip, and the remaining portion of the backing strip then is folded over on top of the fringe margin. Stitch fastening means is again placed in the fringe and backing strip to secure the backing strip in its folded position.

The method of manufacture may also provide for placement of multiple layers of fringe of different color or length to vary the density of the fringe and achieve other aesthetic effects.

Releasable fastening means are placed in each end of the backing strip in order to join the skirt.

DETAILED DESCRIPTION OF A PREFERRED EMBODIMENT

Figure 2:
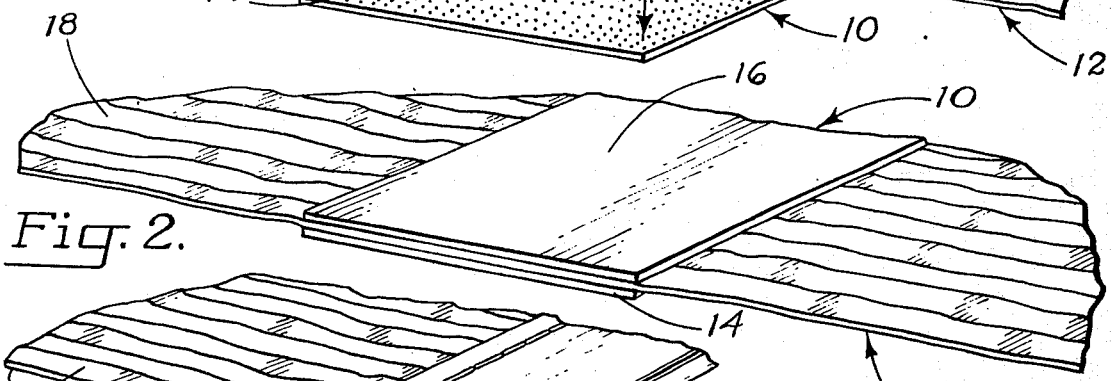
FIG. 2 is a fragmentary, pictorial view similar to FIG. 1 showing the various elements of my invention when partially assembled.
Figure 3:
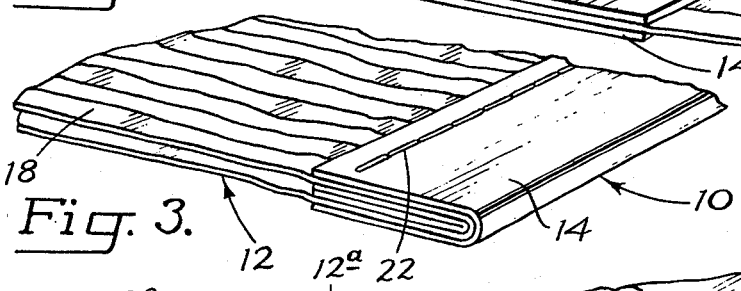
FIG. 3 is a fragmentary, pictorial view of the invention in the completed form.

The preferred embodiment of the garment of the present invention is shown in three typical stages of manufacture in FIGS. 1, 2 and 3, during which backing strip 10 and depending fringe 12 are composited into the final garment assembly.

Backing strip 10 comprises thin, elongate strips of flexible material, normally one to two inches in width and of a length sufficient to fit around the body of the user. For this backing strip I prefer using pieces of pressure sensitive tape, such as masking tape, although other alternatives may be employed. One possible alternative would be to apply a selected adhesive to a non-absorbing backing strip. In this case the adhesive in the dry condition should be flexible to insure that the garment will fit the wearer comfortably.

Fringe 12 comprises a plurality of flexible ribbons 18. I have shown these ribbons as being formed from polyvinyl material about 1 to 8 mils in thickness and approximately 0.2 to 0.3 inches in width. The length of the ribbons would be equal to slightly over twice the length of the finished garment. The final length may be determined by trimming after completion to insure uniformity of the ribbon lengths. Generally, ribbons of two different colors are used, corresponding to the school colors.

In a preferred embodiment of the invention, two backing strips are used in the assembly of the garment. A first backing strip 14 is placed face upward. Fringe 12 is then placed transversely on top of this backing strip intermediate its ends and a second backing strip 16 is placed face downward, sandwiching the fringe in between. If a liquid adhesive is utilized for joinder of the two backing strips, the adhesive would normally be applied after the fringe is positioned on the first strip, as it will naturally flow through the fringe.

Figure 7:
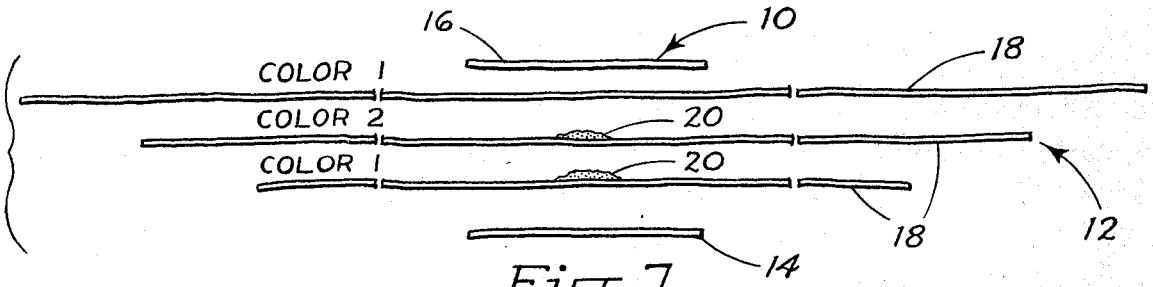
FIG. 7 is a fragmentary, exploded view showing an alternate arrangement of the species of FIG. 1 having a fringe of staggered length ribbons.

In order to increase the density of the garment, multiple layers of the ribbons can be placed on top of each other. As shown in FIG. 7, each upwardly successive layer of ribbons can be made shorter than the succeeding layer and made from a different color material. The resulting garment will have a certain amount of intermixture of the various lengths and colors, however, the overall effect is quite layered and not achievable with present garments of this type.

When multiple layers of ribbons are used for the fringe, their combined thickness may prevent the upper layers from adhering to the first backing strip, and the lower layers from adhering to the second backing strip. In order to make the resulting assembly cohesive in these multi-layered applications, it may be necessary to add a liquid adhesive, as shown at 20.

After the backing strips and fringe are joined adhesively, as shown in FIG. 2, they are folded along the longitudinal center line of the backing strips and secured in this orientation by stitch fastening means 22, as shown in FIG. 3. Stitch fastening means 22 can either be thread, stitched with a sewing machine, or some other type of mechanical fastener, such as staples.

Figure 4:
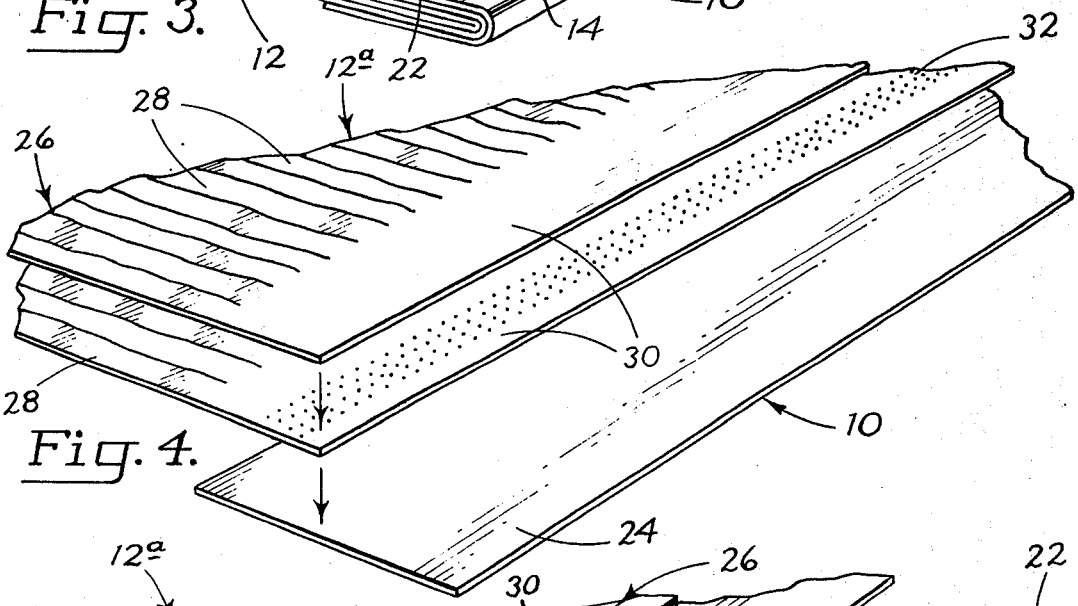
FIG. 4 is a fragmentary, exploded, pictorial view of another species of my invention.
Figure 5:
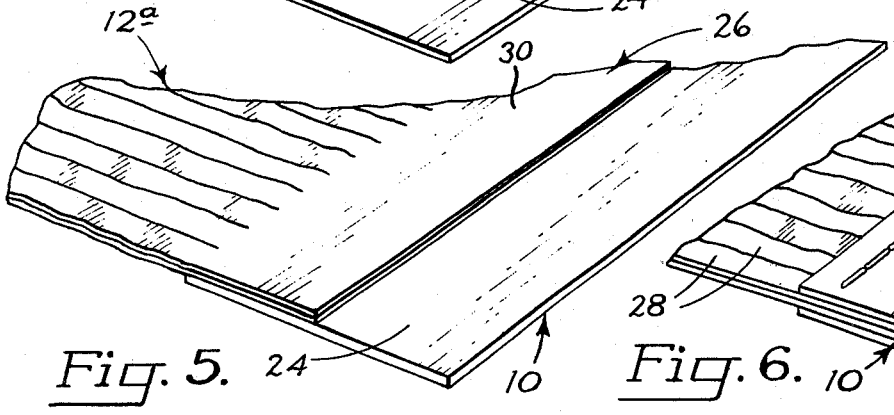
FIG. 5 is a fragmentary, pictorial view of the species of FIG. 4 when partially assembled.
Figure 6:
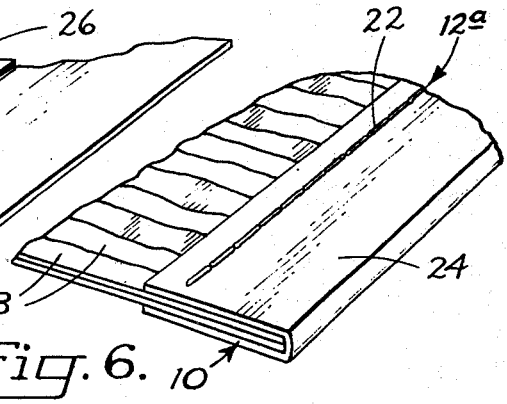
FIG. 6 is a fragmentary, pictorial view of the species of FIG. 4 in the completed form.

Another species of my invention is shown in the same three stages of manufacture in FIGS. 4, 5 and 6. Here the backing strip comprises single backing strip 24 slightly wider than backing strips 14, 16. Again, the backing strip is shown as a piece of pressure sensitive tape; however the alternatives of the first species also could be utilized.

Fringe 12a comprises a sheet 26 die cut or otherwise processed to provide a plurality of adjacent ribbons 28 and continuous margin 30. The sheet may be of the same thickness as are ribbons 18, and ribbons 28 may be of the same width. In order to increase the garment density, several sheets of the fringe may be stacked one on top of another. Since margins 30 are continuous, a bead of liquid adhesive 32 preferably is placed between the margins of adjacent sheets.

The margin of fringe 12a is placed on backing strip 24, with ribbons 28 depending transversely from the backing strip, covering only part of backing strip 24, as shown in FIG. 5. The uncovered portion of backing strip 24 is then folded longitudinally over the fringe, as shown in FIG. 6. Stitch fastening means 22 again secures the assembly.

Figure 8:
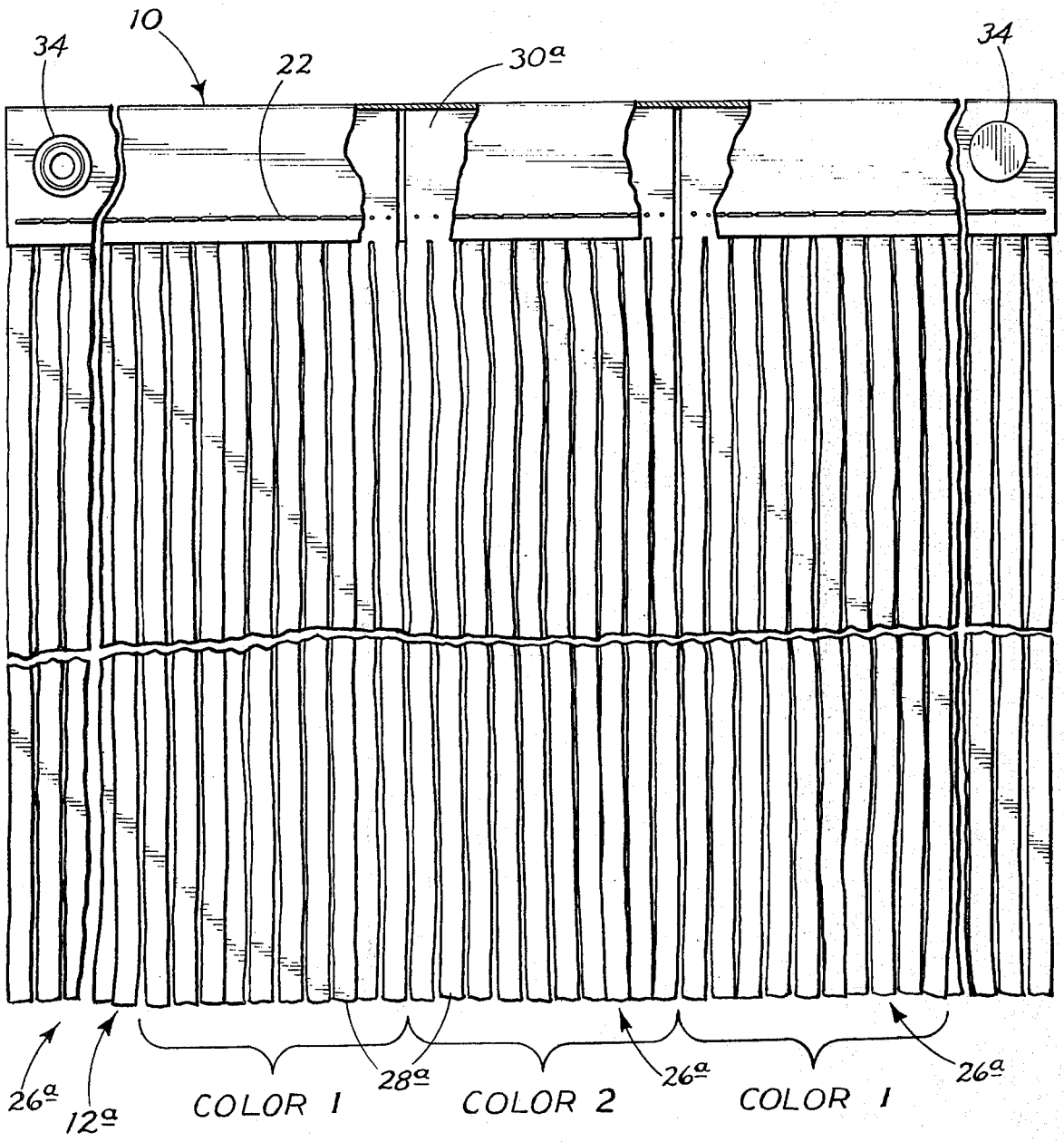
FIG. 8 shows another alternate arrangement of the species of FIG. 1 with the fringe divided into bands of different colors.

A variation, shown in FIG. 8, is to divide fringe 12a into a plurality of segmented sheets **26*a* each having a separate margin 30*a* and ribbons 28*a*. The segmented sheets are positioned with margins 30*a* longitudinally adjacent one another circumferentially around the backing strip. This may be done repetitively, as shown in FIG. 8, with a first segmented sheet of color 1, a second, adjacent segmented sheet of color 2, then starting over again with a third segmented sheet of color 1.** The segments may also be positioned to make each one a different color or to create any pattern desired.

This species of the present invention may also employ successively shorter layers of different colored filaments to achieve the same effect as provided in the first species.

Combinations of these variations are also possible, giving the opportunity to create many color patterns and effects. Likewise, the basic garment of the present invention is not limited to the use of the plastic ribbons shown, and many other ribbon materials or shapes may be utilized in the fringe.

The manner of use of the herein described garment is as follows:

In the first instance, a garment assembly is fabricated according to the foregoing specification. It will be noted that the pressure sensitive tape and/or liquid adhesive holds the assembly during the folding.

The completed assembly is then trimmed lengthwise to give the appropriate body size, and fastening means 34, such as snap fasteners, hook and eye fasteners, or buttons, are placed in each extremity. In order to reduce inventory, a variable position fastener also may be utilized, or the garment may be marketed unsized without fastening means. The user could then cut the garment to length and install the fastening means. The resulting garment is thus made even lower in cost than with sized garments.

An overlay band (not shown) may be attached over backing strip 10 to cover the adhesive or to continue the color pattern of the fringe. Generally the overlay band would be made from cloth, and would mount fastening means 34.

It is to be noted that with either species of the invention and all of the alternatives thereof, it is possible to vary the density or length of the finished garment. In particular, the ribbons tend to cling to the body of the user, thereby increasing the coverage.

It is also to be noted that when the garment is employed as a cheer leader's skirt, it provides unique movement and noise peculiar to its design. The invention makes possible an attractive correlation of the color, design and material of the skirt with the color, design and material of the stranded pom-pons used by cheer leaders. This correlation is unobtainable in the case of the prior art cheer leader's skirts.

Having thus described my invention in preferred embodiments, I claim:

1. A garment comprising:

a. at least one elongated, flexible strip reversely folded along its longitudinal axis to form a waist band, b. a multiplicity of elongated, thin, flexible ribbons disposed side-by-side and reversely folded intermediate their ends, the folded portions of the ribbons being confined between the folded waist band strip and extending outwardly substantially normal thereto to form a fringe skirt having at least a double thickness of ribbons, and c. securing means interconnecting the ribbons and strips for securing them together.

2. The garment of claim 1 including a pair of said elongated flexible strips superimposed one over the other with the ribbons extending between them.

3. The garment of claim 1 wherein the ribbons are of at least two different colors.

4. The garment of claim 1 wherein the ribbons extending from each side of the reverse fold are disposed in a plurality of overlying layers with successive layers being of different lengths.

5. The garment of claim 1 wherein the ribbons extending from each side of the reverse fold are disposed in a plurality of overlying layers with successive layers being of different lengths and colors.

6. The method of making a garment, comprising:

a. arranging a multiplicity of elongated, thin, flexible ribbons side-by-side, b. arranging at least one elongated, flexible backing strip across the ribbons intermediate the ends of the latter, c. securing the ribbons and strip together, and d. reversely folding the backing strip and secured ribbons along the longitudinal axis of the strip to form a waist band of the strip and a fringe skirt having at least a double thickness of ribbons.

7. The method of claim 6 including arranging a pair of elongated, flexible backing strips across the ribbons on opposite sides thereof.

8. The method of claim 6 wherein the ribbons are arranged in a plurality of overlying layers with each successive layer of ribbons being of different length.

9. The method of claim 6 wherein the ribbons are arranged in a plurality of overlying layers with each successive layer of ribbons being of different color.

10. The method of claim 6 wherein the ribbons are arranged in a plurality of overlying layers with each successive layer of ribbons being of different length and color.

11. A garment comprising:

a. at least one backing strip, b. a fringe overlying the backing strip and disposed transversely thereto, the fringe comprising a plurality of thin, flexible cut sheets each having a short margin and longer, attached, narrow ribbons, the cut sheets being disposed in multiple overlying layers with successive layers being of both different lengths and different colors, the sheets being disposed transversely of the backing strip with the backing strip reversely folded along its longitudinal axis around the margins of the sheets, c. securing means interconnecting the margins and backing strip for securing them together, and d. fastening means on each end portion of the backing strip for fastening the backing strip around the body of a wearer.

12. The method of manufacturing a garment, comprising:

a. providing at least one backing strip and a fringe, the fringe comprising a plurality of overlying layers of thin, flexible cut sheets with successive layers being of different colors and lengths, each sheet having a short margin and longer, attached, narrow ribbons, b. disposing the plurality of overlying layers of cut sheets with the margins overlying the backing strip and the ribbons extending transversely therefrom, c. reversely folding the backing strip along its longitudinal axis about the margins of the fringe, and d. securing the fringe and folded backing strip together.

* * * * *